United States Patent [19]

Grisé et al.

[11] 3,930,287

[45] Jan. 6, 1976

[54] ADJUSTABLE STRAP

[76] Inventors: Frederick G. J. Grisé; Walter C. Lovell, both of Mountain Road, Wilbraham, Mass. 01067; Ray E. Heck, Pleasant St., Brookfield, Mass. 01585; Kalman Prescott, Sturbridge, Mass. 01566

[22] Filed: Nov. 21, 1974

[21] Appl. No.: 525,821

[52] U.S. Cl. ..... 24/16 PB

[51] Int. Cl.[2] ..... B65D 63/00

[58] Field of Search ..... 24/201 A, 230 B, 206 A, 24/16 PB, 17 A, 17 AP, 30.5 P, 20 CW

[56] References Cited

UNITED STATES PATENTS

| | | | |
|---|---|---|---|
| 1,278,779 | 9/1918 | Springer | 24/20 CW UX |
| 1,804,725 | 5/1931 | Walker | 24/206 A UX |
| 2,466,742 | 4/1949 | Roehrl | 24/206 A |
| 3,156,922 | 11/1964 | Anderson | 24/16 PB UX |
| 3,842,688 | 10/1974 | Baginski | 24/206 A X |

FOREIGN PATENTS OR APPLICATIONS

| | | | |
|---|---|---|---|
| 1,251,076 | 12/1960 | France | 24/206 A |
| 158,021 | 1/1933 | Switzerland | 24/206 A |

*Primary Examiner*—Donald A. Griffin

[57] ABSTRACT

An adjustable strap comprising two pieces of relatively soft elastomeric elongated strips. The strips are interconnected, one strip having an opening through which the other strip passes. The strip having the opening has a longitudinal central elongated depression therein provided with a series of upstanding teeth; and the strip threaded through the opening is provided with an elongated series of upstanding teeth slanting in the opposite direction for engagement with the teeth in the depression at any desired point of adjustment along the strap, there being another connection between the two straps.

6 Claims, 4 Drawing Figures

ADJUSTABLE STRAP

BACKGROUND OF THE INVENTION

There is a definite need for inexpensive holding straps for any desired purpose e.g., wrist watch straps, belts, head bands, and binding and strapping means in general, and it is the object of the present invention to provide a very inexpensively manufactured, long lasting strap having a connection that is easily operated and holds positively against longitudinal pull.

SUMMARY OF THE INVENTION

There are provided two elongated strips of elastomeric material. At the leading end of one strip there is provided means forming a slot through which the other strip extends, each of the strips having connection means to extraneous devices at the opposite ends thereof together with corrugated means forming more resilient extensions of both of the strips. At the leading end of the said other strip, threaded through the slot, there is a simple lateral edge detachable connection between the strips.

The said one strip having the slot is provided with a longitudinal depression therein and in the bottom of the depression there are formed a series of slanting teeth; the other strip having a projecting similar series of slanting teeth for engagement therewith, the teeth of the strips slanting in opposite directions for positive engagement thereof in longitudinally adjusted condition of the strips. When interengaged, the connection cannot be dislocated in a longitudinal direction but by disengaging the leading end of the strip having the projecting teeth, all of the teeth can be disengaged by pulling the strip with the projecting teeth away in a transverse direction from the length of the strap. Thus the strap can be removed from an object to which it was attached, or it can be longitudinally adjusted.

PREFERRED EMBODIMENT OF THE INVENTION

There are two elongated narrow elastomeric strips 10 and 12, each strip being provided at its extreme end portion with a device such as the slot formed by the bridge at 14, 14 for attaching extraneous objects thereto as desired or needed. Inwardly from these attaching means there are accordion or pleated areas 16, 16 providing for extra stretch.

Figure 1:
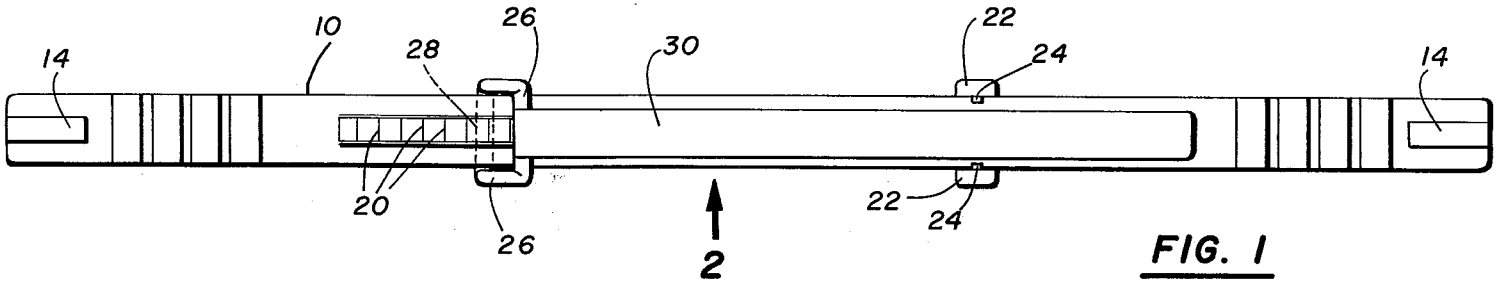
FIG. 1 is a plan view illustrating the invention.
Figure 2:
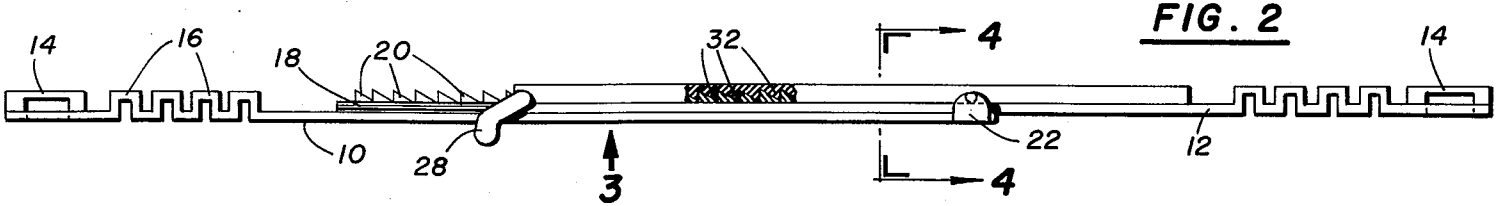
FIG. 2 is an edge view looking in the direction of arrow 2 in FIG. 1.
Figure 3:
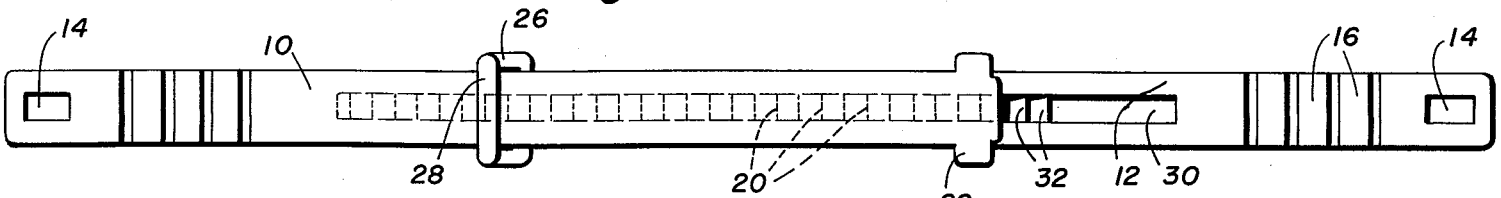
FIG. 3 is a bottom plan view.
Figure 4:
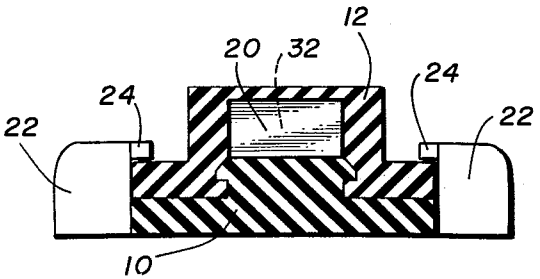
FIG. 4 is a section on an enlarged scale.

The elastomeric strip 10 is provided with a longitudinal central upstanding rib 18 on which are integrally formed a long series of slanting teeth 20 and it will be noted in FIG. 2 that these teeth slant to the left.

At the extreme end of strip 10 there are a pair of lateral projections 22, 22 with small overhangs 24, 24 for the purpose of slidably embracing the side edges of strip 12. Strip 12 has at one end a continuously formed member generally indicated at 26 which has a portion at 28 underlying strip 10 and forming a slot through which strip 10 is threaded and slidable.

Strip 12 is provided with a bottom longitudinal slot or recess in an upwardly projecting rib 30 and the bottom of the slot is provided with slanting teeth 32 which are similar in size to the teeth 20, but slant in the opposite direction. These teeth extend substantially for the length of the projection 30.

After threading the leading end of strip 10 through the slot formed by the member 28, the strips are overlapped to whatever length is decided to be desirable and the overhangs 24 are positioned to embrace the edges of strip 12. Merely by pressing the leading end of strip 10 upwardly in FIG. 2 from the dotted line to the solid line position, the slanting teeth will interengage and every tooth that is engaged with an opposite tooth will act as a holding means, so that it will be seen that the holding power against detachment in the longitudinal direction is greatly increased. The only way to separate or readjust the strips is to detach the overhangs or the members 22 from the edges of strip 12 and merely pull up (or out) the leading end of strip 10 so as to disengage the piece 20 and 32, whereupon the strip 10 may be slid out through the slot formed by the member 28. This releases an object held, and the strips can be reapplied and re-adjusted.

We claim:

1. An adjustable strap comprising a pair of elongated elastomeric strips, interengaging means on said strips at corresponding ends providing for longitudinal adjustment of said strips relative to each other and preventing separation of the strips in a direction normal to the lengths of the strips, elongated series of slanting teeth on each strip, said teeth being complementary to each other and slanting in opposite directions for engagement thereof preventing separation of the strips in a longitudinal direction, the teeth being located on the strips extending inwardly from the ends thereof that have the interengaging means, the means holding the strips from separation in a direction normal thereto being manually removable to allow adjustment and separation of said strips, wherein the slanting teeth of one strip extend outwardly from a side surface thereof, the other strip including a longitudinal recess, the slanting teeth of the second strip being located in the bottom of said recess, the projecting slanting teeth being engageable with the teeth in the recess when the two strips are in flat contacting relation.

2. The strap of claim 1 wherein the slanting teeth on one strip project from the surface of said strip.

3. The strap of claim 1 wherein the slanting teeth on one strip are inset in a longitudinal recess.

4. The strap of claim 1 wherein said interengaging means comprises means forming a slot in one strip through which the other strip extends.

5. The strap of claim 4 including overhanging means at the side edges of one strip to removably embrace the side edges of the other strip at a point remote from the slot.

6. The strap of claim 1 wherein the slanting teeth of one strip extend outwardly from a side surface thereof, the other strip including a longitudinal recess, the slanting teeth of the second strip being located in the bottom of said recess, the projecting slanting teeth being engageable with the teeth in the recess when the two strips are in flat contacting relation.

* * * * *